US007956264B2

(12) United States Patent
Risolia

(10) Patent No.: US 7,956,264 B2
(45) Date of Patent: Jun. 7, 2011

(54) INSTRUMENT PICK

(76) Inventor: Joseph R. Risolia, Miami Beach, FL (US)

( * ) Notice: Subject to any disclaimer, the term of this patent is extended or adjusted under 35 U.S.C. 154(b) by 13 days.

(21) Appl. No.: 12/557,954

(22) Filed: Sep. 11, 2009

(65) Prior Publication Data

US 2010/0058918 A1 Mar. 11, 2010

Related U.S. Application Data

(60) Provisional application No. 61/191,553, filed on Sep. 11, 2008.

(51) Int. Cl.
*G10D 3/16* (2006.01)

(52) U.S. Cl. ..... 84/322; 84/320

(58) Field of Classification Search ..... 84/320, 84/322; 600/15
See application file for complete search history.

(56) References Cited

U.S. PATENT DOCUMENTS

| | | | | | |
|---|---|---|---|---|---|
| 1,634,373 | A | * | 7/1927 | Mann | 600/13 |
| 3,181,410 | A | * | 5/1965 | Phillips | 84/322 |
| 4,064,781 | A | * | 12/1977 | Fals | 84/322 |
| 4,137,814 | A | | 2/1979 | Rowley | |
| 4,303,062 | A | | 12/1981 | Vars | |
| 4,785,708 | A | | 11/1988 | Vaughan | |
| 4,982,641 | A | | 1/1991 | Duhart | |
| 5,017,185 | A | * | 5/1991 | Baermann | 600/15 |
| D334,535 | S | * | 4/1993 | Piccione et al. | D9/732 |
| 5,488,892 | A | | 2/1996 | Jepsen | |
| 5,965,282 | A | * | 10/1999 | Baermann | 428/800 |
| 6,245,006 | B1 | * | 6/2001 | Olson | 600/15 |
| 6,332,862 | B1 | * | 12/2001 | Zandman | 600/15 |
| 6,344,021 | B1 | * | 2/2002 | Juster et al. | 600/15 |
| 6,383,129 | B1 | * | 5/2002 | Ardizzone et al. | 600/9 |
| 6,773,391 | B1 | * | 8/2004 | Bricot | 600/15 |
| 6,846,977 | B2 | * | 1/2005 | Oskorep | 84/322 |
| 6,926,661 | B2 | * | 8/2005 | Snyder | 600/15 |
| 6,933,430 | B2 | * | 8/2005 | Oskorep | 84/322 |
| 6,939,287 | B1 | * | 9/2005 | Ardizzone et al. | 600/9 |
| 6,977,330 | B2 | * | 12/2005 | Santa Cruz et al. | 84/322 |
| 7,312,388 | B2 | * | 12/2007 | Oskorep | 84/322 |
| 7,399,270 | B2 | * | 7/2008 | Holcomb | 600/15 |
| D594,753 | S | * | 6/2009 | Eadicicco et al. | D9/732 |
| 7,611,453 | B2 | * | 11/2009 | Pilla et al. | 600/15 |
| 7,626,103 | B1 | * | 12/2009 | Phillips | 84/320 |
| 2004/0111005 | A1 | * | 6/2004 | Lu | 600/15 |
| 2004/0237753 | A1 | * | 12/2004 | Savage | 84/322 |
| 2005/0101828 | A1 | * | 5/2005 | Butler et al. | 600/15 |
| 2005/0148809 | A1 | * | 7/2005 | Delaney | 600/15 |
| 2007/0179333 | A1 | * | 8/2007 | Bove | 600/15 |
| 2009/0084244 | A1 | * | 4/2009 | Goad | 84/320 |
| 2010/0058918 | A1 | * | 3/2010 | Risolia | 84/322 |

* cited by examiner

*Primary Examiner* — Jeffrey Donels
*Assistant Examiner* — Robert W Horn
(74) *Attorney, Agent, or Firm* — Webb IP Law Group; Jason P. Webb; Danny Y. H. Cheng

(57) ABSTRACT

There is an instrument pick configured to selectably couple to a metal surface of an instrument, according to one embodiment of the invention. The instrumental pick includes a base member having an interior cavity and a magnet disposed within the interior cavity of the base member. The base member of the instrumental pick also includes a plurality of apertures configured to dispose a portion of the magnet.

7 Claims, 4 Drawing Sheets

INSTRUMENT PICK

CROSS-REFERENCE TO RELATED APPLICATIONS

This invention claims priority, under 35 U.S.C. §120, to the U.S. Provisional Patent Application No. 61/191,553 to Joseph Risolia, filed on Sep. 11, 2008, which is incorporated by reference herein in its entirety.

BACKGROUND OF THE INVENTION

1. Field of the Invention

The present invention relates to musical instruments, specifically to a magnetic guitar pick.

2. Description of the Related Art

A guitar pick is a type of plectrum designed for use on a guitar. Over time people have made picks of various materials, including plastic, rubber, felt, tortoiseshell, wood, metal, glass, and stone. They most often take the shape of an acute isosceles triangle with the two equal corners very rounded and the third corner rounded to a lesser extent. This shape is, however, merely one of many used by manufacturers.

Pick shapes started with guitarists filing down bone, shell, wood, cuttlebone, metal, amber, stone or ivory to get the desired shape. Most users of picks are familiar with the most popular shape, the 351, which is merely the rounding off of the top of heart, which was a popular pick shape early on. The rounded triangle is the 346 and the small jazz pick, the 358.

Guitar picks vary in thickness to accommodate different playing styles and kinds of strings. Thinner plectra are more flexible and tend to offer a wider range of sounds, from soft to loud, and produce a "click" that emphasizes the attack of the picking. However, some argue that heavier picks produce a brighter tone. Picks are usually gripped with two fingers—thumb and index—and are played with pointed end facing the strings. However, it's a matter of personal preference and many notable musicians use different grips.

The motion of the pick against the string is also a personal choice. George Benson and Dave Mustaine, for example, hold the pick very stiffly between the thumb and index finger, locking the thumb joint and striking with the surface of the pick nearly parallel to the string, for a very positive, articulate, consistent tone. Other guitarists have developed a technique known as circle picking, where the thumb joint is bent on the downstroke, and straightened on the upstroke, causing the tip of the pick to move in a circular pattern. Circle picking can allow greater speed and fluidity. The angle of the pick against the string is also very personal and has a broad range of effects on tone and articulation. Many rock guitarists will use a flourish (called a pick slide or pick scrape) that involves scraping the pick along the length of a round wound string (a round wound string is a string with a coil of round wire wrapped around the outside, used for the heaviest three or four strings on a guitar).

Some improvements have been made in the field. Examples of references related to the present invention are described below, and the supported teachings of each reference are incorporated by reference herein:

The following references are presented for their supported teachings herein: U.S. Pat. No. 5,488,892, issued to Jepsen; U.S. Pat. No. 4,785,708, issued to Vaughan; U.S. Pat. No. 4,982,641, issued to Duhart; U.S. Pat. No. 4,303,062, issued to Vars; U.S. Pat. No. 6,245,006, issued to Olson; and U.S. Pat. No. 4,137,814 issued to Rowley.

The inventions heretofore known suffer from a number of disadvantages which include being limited in application, being limited in adaptability, being expensive, being non-durable, being flimsy, being heavy, and being difficult to use.

What is needed is a magnetic guitar pick that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available magnetic picks. Accordingly, the present invention has been developed to provide a guitar pick easily disposed on a guitar for easy access for use.

According to one embodiment of the invention, there is an instrument pick configured to selectably couple to a metal surface of an instrument. The instrumental pick may include a base member having an interior cavity and a magnet disposed within the interior cavity of the base member. The base member of the instrumental pick may also include a plurality of apertures configured to dispose a portion of the magnet.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

In one embodiment, there is an instrument pick configured to facilitate play and to selectably couple to a metal surface of a stringed instrument. The pick may include one or more of a base member that may have a blister-like portion of the base member forming an interior cavity and/or including a plurality of apertures therethrough; and/or a peripheral flange that may be extending from the blistered portion of the base member and/or configured to contact strings of a stringed instrument during use; and/or a magnet that may be disposed within the interior cavity of the base member and/or oriented such that flux lines of the magnet are substantially perpendicular to the plane of the base member. The magnet may be flexible. The magnet may be a disc and/or may be centrally and/or symmetrically disposed in the base member. There may be a second magnet that may be disposed on a surface of the base member. There may be a logo disposed about the base member.

In another embodiment, there may be a method of therapeutic treatment of hands, comprising one or more of the steps of grasping a magnetic pick shaped to be utilized in playing a stringed instrument; and/or playing the stringed instrument with the magnetic pick. It may be that the magnetic pick includes a pair of magnets, that the magnetic pick includes a flexible magnet, that the magnetic pick comprises a base member having a blister-like portion of the base member forming an interior cavity and including a plurality of apertures therethrough; and/or a peripheral flange extending from the blistered portion of the base member and configured to contact strings of a stringed instrument during use; and/or a magnet disposed within the interior cavity of the base member and oriented such that flux lines of the magnet are substantially perpendicular to the plane of the base member. The method may include measuring a health indicator and/or grasping and/or using a second magnetic pick that may have a different characteristic from the first magnetic pick.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
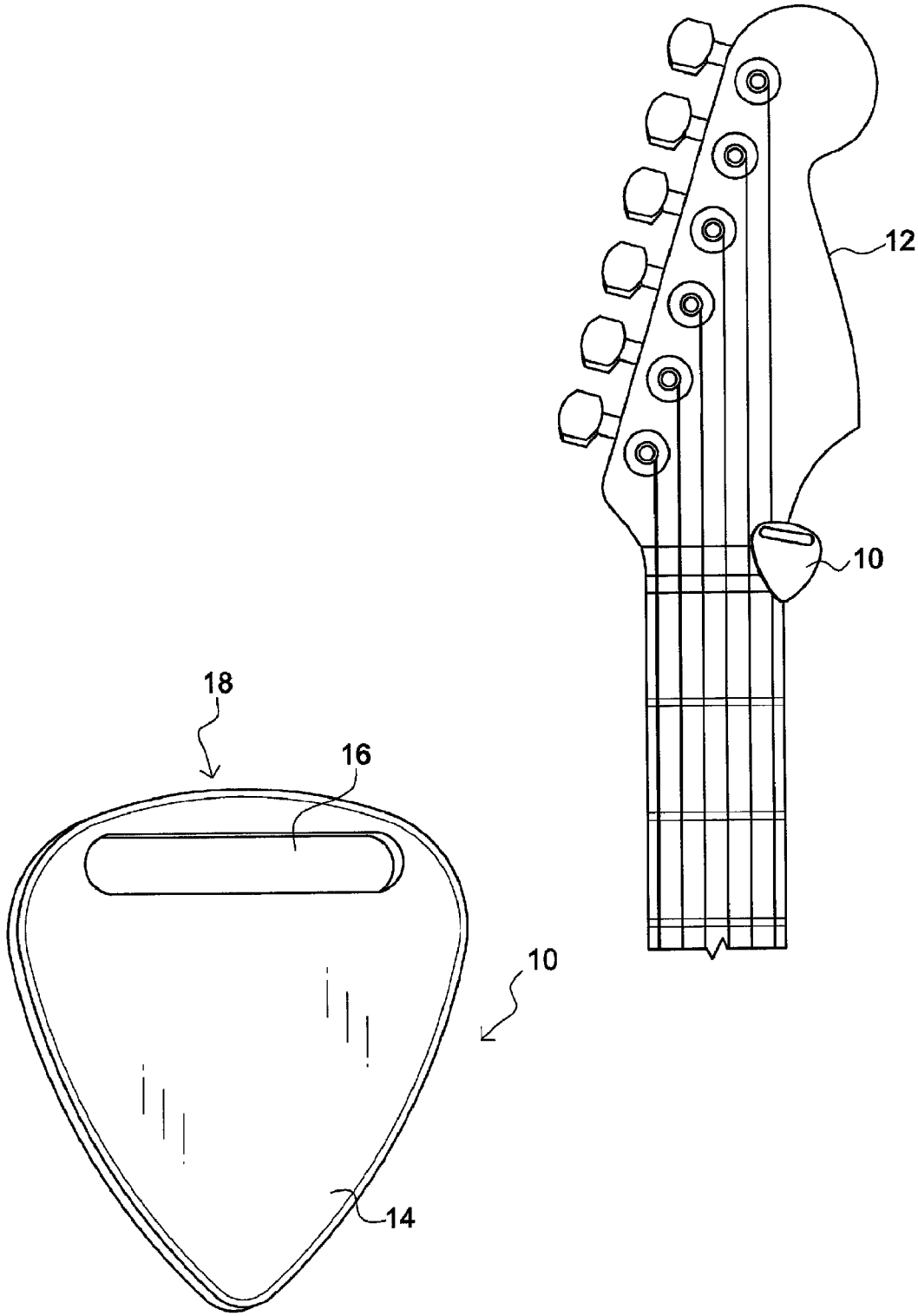
FIG. 1 is a perspective view of a magnetic guitar pick and a perspective view of a magnetic guitar pick coupled to a guitar string, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

In one embodiment of the invention there is a pick having magnetic properties. There may be a permanent magnet coupled to and/or integrated within the pick. The permanent magnet may be oriented with field lines extending outward from the plane of the pick. The permanent magnet may generate a magnetic field through the fingers and/or hand of a user when in use. It is theorized, without limitation to any particular theory of operation, that the magnetic field lines operate on the systems of the body to enhance health of a user, such as but not limited to enhancing blood flow, enhancing the operation of material exchange at the blood cell level, facilitating the migration of resources to cells, and/or enhancing cell membrane operation. There may be more than one magnet coupled and/or disposed on or in the pick. The pick may be constructed of a flexible ferromagnetic material. The magnet shape and/or size may be selected to alter a flexibility characteristic of the pick and thereby alter play characteristics when in use.

There may be a method of therapy including one or more of the steps of providing a magnetic pick and playing an instrument using the provided magnetic pick. There may be a step of measuring a health indicator, such as but not limited to blood flow, nutrient transfer, oxygen level, and the like of an area of the body associated with operation of the magnetic pick, such as but not limited to a hand or fingers. There may be a step of providing a second magnetic pick having a different characteristic, such as but not limited to magnet strength, magnet size, pick flexibility, and the like, wherein the characteristic is chosen based on a measured health indicator.

FIG. 1 is a perspective view of a magnetic guitar pick and a perspective view of a magnetic guitar pick coupled to a guitar string, according to one embodiment of the invention. There is an instrument pick 10 configured to selectably couple to a metal surface of an instrument 12. The instrumental pick 10 includes a base member 14 having a magnet 16 disposed on a surface 18 of the base member 14.

In operation of one embodiment of the invention, the user grips the magnetic guitar pick and strums guitar strings of a guitar. The user disposes the base member about a guitar string, bridge, or neck of a guitar and the magnet selectably couples to the metal of the guitar strings, bridge, or neck of the guitar, thereby securing the magnetic guitar pick to the guitar.

Figure 2:
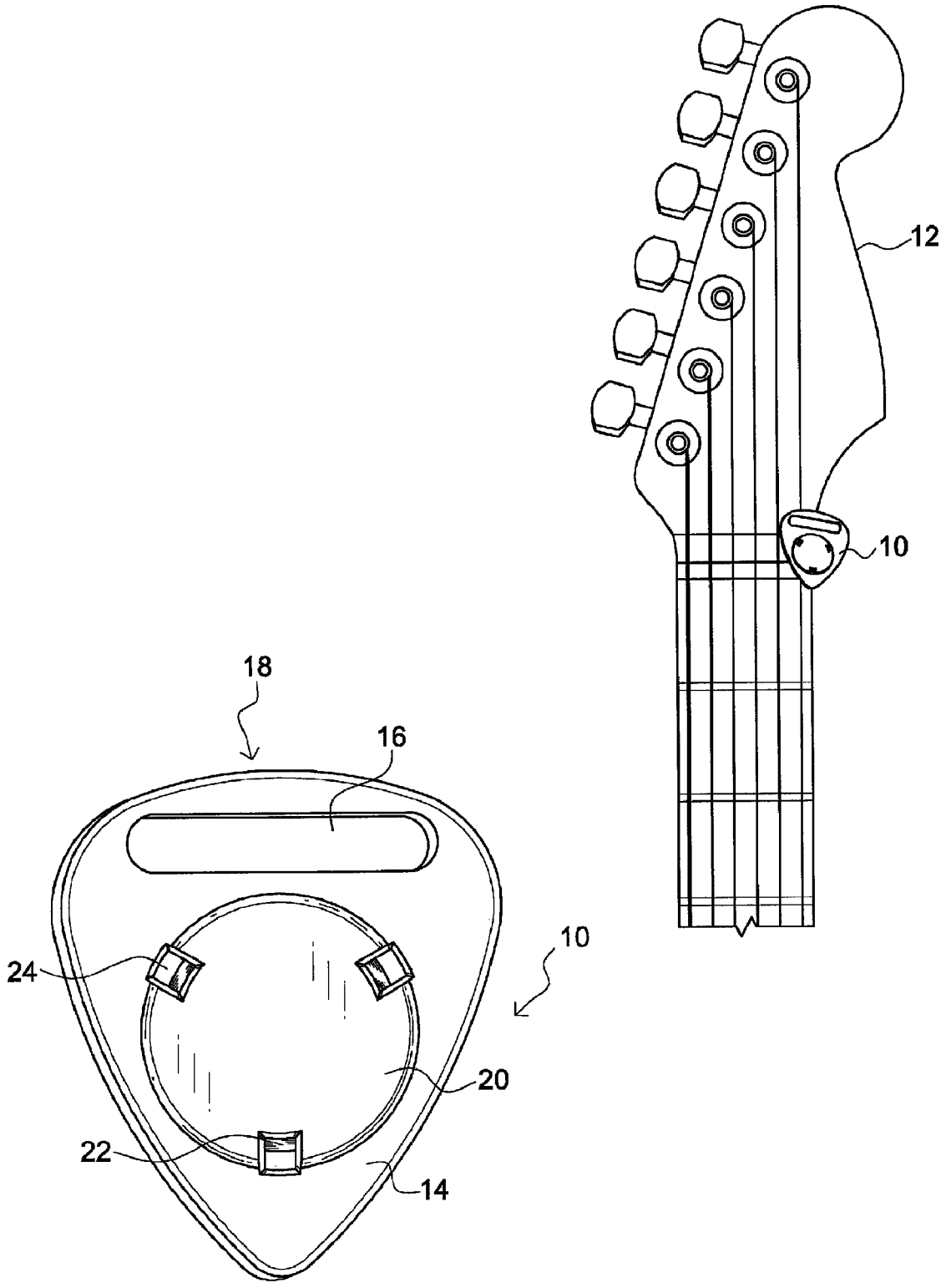
FIG. 2 is a perspective view of a magnetic guitar pick and a perspective view of a magnetic guitar pick coupled to a guitar string, according to one embodiment of the invention.

FIG. 2 is a perspective view of a magnetic guitar pick and a perspective view of a magnetic guitar pick coupled to a guitar string, according to one embodiment of the invention. There is an instrument pick 10 configured to selectably couple to a metal surface of an instrument 12. The instrumental pick 10 includes a base member 14 having a magnet 16 disposed on a surface 18 of the base member 14. The instrumental pick 10 also includes an interior cavity 20 and a magnet 22 disposed within the interior cavity 20 of the base member 14. The base member 14 of the instrumental pick 10 also includes a plurality of apertures 24 configured to dispose a portion of the magnet 22. The plurality of apertures 24 is configured to secure the magnet 22 in a substantially center position, relative to the base member, to provide a uniform and symmetrical instrument pick.

In operation of one embodiment of the invention, the user grips the magnetic guitar pick about the aperture of the base member and strums guitar strings of a guitar. The user disposes the magnet disposed within the interior cavity about a metal surface of the guitar, i.e. guitar strings, guitar bridge, etc., thereby securing the magnetic guitar pick to the guitar. In addition, the user disposes the base member about a guitar string, bridge, or neck of a guitar and the magnet selectably couples to the metal of the guitar strings, bridge, or neck of the guitar, thereby securing the magnetic guitar pick to the guitar.

Figure 3:
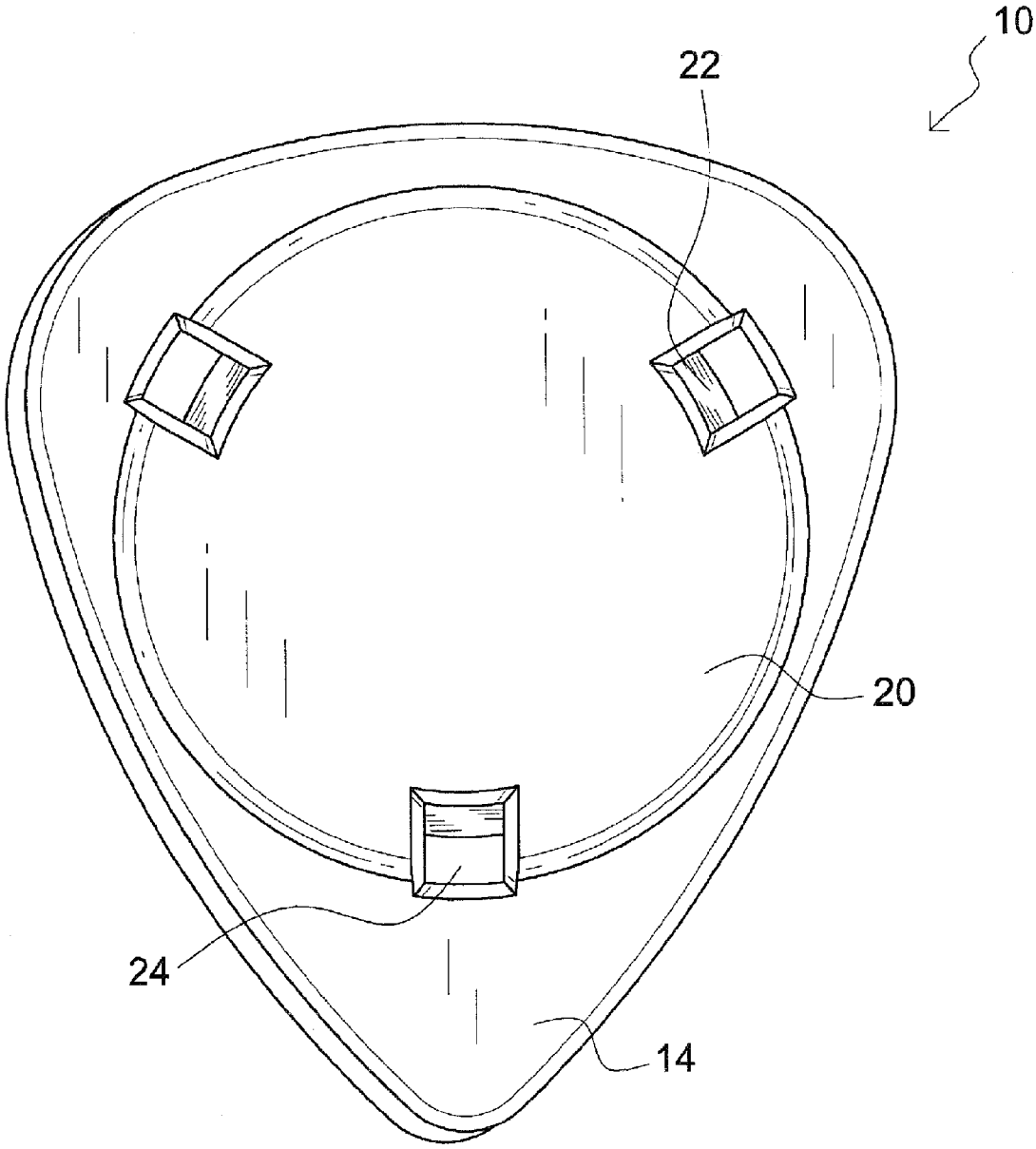
FIG. 3 is a perspective view of a magnetic guitar pick, according to one embodiment of the invention.

FIG. 3 is a perspective view of a magnetic guitar pick, according to one embodiment of the invention. There is an instrument pick 10 configured to selectably couple to a metal surface of an instrument. The instrumental pick 10 includes a base 14 member having an interior cavity 20 and a magnet 22 disposed within the interior cavity 20 of the base member 14. The base member 14 of the instrumental pick 10 also includes a plurality of apertures 24 configured to dispose a portion of the magnet 22. As illustrated in FIG. 3, the instrument pick 10 includes a magnet 22 disposed within the base member 14.

Figure 4:
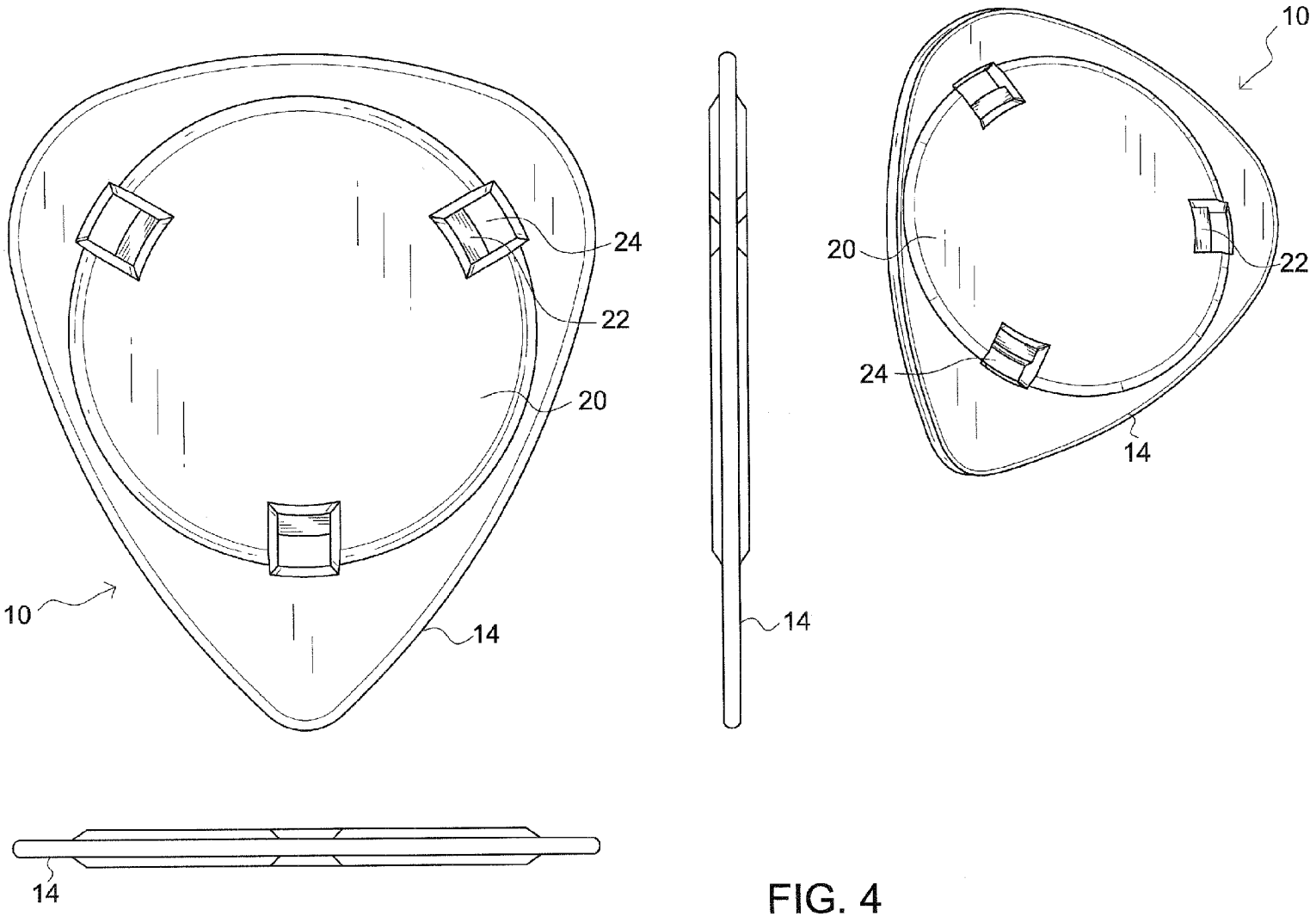
FIG. 4 is a set of views of a magnetic guitar pick, according to one embodiment of the invention.

FIG. 4 is a set of views of a magnetic guitar pick, according to one embodiment of the invention. There is an instrument pick 10 configured to selectably couple to a metal surface of an instrument. The instrumental pick 10 includes a base member 14 having an interior cavity 20 and a magnet 22 disposed within the interior cavity 20 of the base member 14. The base member 14 of the instrumental pick 10 also includes a plurality of apertures 24 configured to permit centering of the magnet during injection molding.

In operation of one embodiment of the invention, the user grips the magnetic guitar pick about the aperture of the base member and strums guitar strings of a guitar. The user is able to strum and strike the strings with better accuracy and tone as the instrument pick is rigid in configuration. The user disposes the magnet disposed within the interior cavity about a metal surface of the guitar, i.e. guitar strings, guitar bridge, etc., thereby securing the magnetic guitar pick to the guitar.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the Figures illustrate an instrument pick selectably coupled to a guitar string of a guitar, one skilled in the art would appreciate that the instrument pick may couple to any metal surface of an instrument not limited to guitar strings and not limited to guitar and still perform its intended function. In addition, the instrument pick may include a plurality of magnets disposed on either surface of the base member, within the base member, and in any configuration, magnetic orientation, design about the base member, and still perform its intended function.

Additionally, although the figures illustrate an interior cavity configured to secure a magnet therein, one skilled in the art would appreciate that the magnet may be incorporated into the base member without an interior cavity and still perform its intended function.

It is envisioned that the base member also includes a gripping surface disposed on the base member configured to provide a secure grip for a user while using the instrument pick and still perform its intended function.

It is also envisioned that the instrument pick includes a logo design disposed about the base member of the instrument pick and still perform its intended function.

It is expected that there could be numerous variations of the design of this invention. An example is that the magnet may vary in strength and still perform its intended function. In addition, the magnet may be a therapeutic magnet configured to apply therapy to fingers and hands of users while playing an instrument and still perform its intended function.

Finally, it is envisioned that the components of the device may be constructed of a variety of materials, such as but not limited to, plastic, plastic composite, rubber, rubber composite, metal, metal alloys, textiles, magnets, etc. and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. An instrument pick configured to facilitate play and to selectably couple to a metal surface of a stringed instrument, comprising:

a) a base member having:

a. a blister-like portion of the base member forming an interior cavity and including a plurality of apertures therethrough; and b. a peripheral flange extending from the blistered portion of the base member and configured to contact strings of a stringed instrument during use; and b) a magnet disposed within the interior cavity of the base member and oriented such that flux lines of the magnet are substantially perpendicular to the plane of the base member.

2. The pick of claim 1, wherein the magnet is flexible.

3. The pick of claim 1, wherein the magnet is a disc and is centrally and symmetrically disposed in the base member.

4. The pick of claim 1, further comprising a second magnet disposed on a surface of the base member.

5. The pick of claim 1, further comprising a logo disposed about the base member.

6. An instrument pick configured to facilitate play and to selectably couple to a metal surface of a stringed instrument, comprising:

a) a base member having an interior cavity;

b) a magnet disposed within the interior cavity of the base member and oriented such that flux lines of the magnet are substantially perpendicular to the plane of the base member; wherein the magnet is flexible; wherein the magnet is a disc and is centrally and symmetrically disposed in the base member;

c) a second magnet disposed on a surface of the base member; and d) a logo disposed about the base member; wherein the base member includes a blister-like portion forming the interior cavity.

7. The pick of claim 6, wherein the base member further comprises a peripheral flange extending from the blistered portion of the base member and configured to contact strings of a stringed instrument during use.

* * * * *